United States Patent [19]

Siklosi

[11] Patent Number: 4,769,172

[45] Date of Patent: Sep. 6, 1988

[54] BUILT DETERGENT COMPOSITIONS CONTAINING POLYALKYLENEGLYCOLIMINODIACETIC ACID

[75] Inventor: Michael P. Siklosi, Cincinnati, Ohio

[73] Assignee: The Proctor & Gamble Company, Cincinnati, Ohio

[21] Appl. No.: 91,491

[22] Filed: Sep. 3, 1987

Related U.S. Application Data

[63] Continuation-in-part of Ser. No. 64,045, Jun. 19, 1987, abandoned, which is a continuation-in-part of Ser. No. 910,561, Sep. 22, 1986, abandoned.

[51] Int. Cl.[4] ..... C11D 3/33; C11D 3/43; C11D 17/08

[52] U.S. Cl. ..... 252/153; 134/40; 252/170; 252/171; 252/173; 252/527; 252/546; 252/DIG. 10; 252/DIG. 11; 562/568; 562/571

[58] Field of Search ..... 252/153, 170, 171, 173, 252/527, 546, DIG. 11, DIG. 10; 562/568, 571

[56] References Cited

U.S. PATENT DOCUMENTS

| | | | |
|---|---|---|---|
| 3,829,387 | 8/1974 | Wise | 252/156 |
| 3,882,038 | 5/1975 | Clayton | 252/164 |
| 4,285,575 | 8/1981 | Imataki | 252/500 |
| 4,287,080 | 9/1981 | Siklosi | 252/104 |
| 4,692,277 | 9/1987 | Siklosi | 252/558 |

FOREIGN PATENT DOCUMENTS

| | | |
|---|---|---|
| 2314449 | 3/1972 | Fed. Rep. of Germany . |
| 59-70652 | 4/1984 | Japan . |

OTHER PUBLICATIONS

EPA Bulletin—600/2-74-003, (pp. 36-38), (Schwartz, et al.).

*Primary Examiner*—Dennis Albrecht
*Attorney, Agent, or Firm*—Robert B. Aylor; Richard C. Witte

[57] ABSTRACT

Detergent compositions comprising an organic synthetic detergent and N-polyalkyleneglycol-N,N-diacetic acid as a builder, with, optionally, organic solvents such as mono- and di-propyleneglycolmonobutyl ethers. The compositions are hard surface cleaners having reduced filming and streaking characteristics.

13 Claims, No Drawings

BUILT DETERGENT COMPOSITIONS CONTAINING POLYALKYLENEGLYCOLIMINODIACETIC ACID

CROSS-REFERENCE TO RELATED APPLICATIONS

This is a continuation-in-part of U.S. Pat. Application Ser. No. 06/064,045, filed June 19, 1987, which is a continuation-in-part of U.S. Pat. Application Ser. No. 06/910,561, filed Sept. 22, 1986 both of said applications being abandoned.

FIELD OF THE INVENTION

This invention pertains to detergent compositions which contain nonphosphorous detergency builders.

BACKGROUND OF THE INVENTION

The use of detergency builders as adjuncts to organic water-soluble synthetic detergents and the property which these materials have of improving the overall detergency performance of such detergents are well known phenomena. Polyphosphates have been the most commonly used builders and within this class alkali metal, e.g., sodium and potassium, polyphosphates and pyrophosphates have been most preferred. An important function of builders in detergency is to sequester polyvalent metal ions (e.g., $Ca^{2+}$ and $Mg^{2+}$) in aqueous solutions of the detergent composition.

In recent years public attention has been drawn to the role of phosphates generally in the life cycle of lakes, and specifically to the contribution by detergent phosphates to this process. An imbalance of nutrients, e.g., carbon, nitrogen, phosphates and the like in lakes appears to adversely affect the ecological balance between algae and fish. The consequence is that an ordinary and natural lake-aging process can be accelerated. Accordingly, there has been considerable effort in recent years directed to the discovery of nonphosphorous materials which would act as effective builders and thus make it possible to formulate highly effective detergent compositions in which phosphorous-containing builders are wholly or partially replaced by nonphosphorous-containing builders.

Because of the human exposure involved in the use of detergent products, it is essential that the ingredients used therein be satisfactory from the standpoint of toxicological safety. Thus, a detergent builder material must be safe, as well as effective.

The compound 2-hydroxyethyl-N,N-diacetic acid (HEIDA) has been disclosed in the literature as an effective nonphosphorous detergency builder. See West German Patent Application DT No. 2314449 to Mooch Domsjo AB, published Mar. 27, 1972, and Environmental Protection Agency Publication EPA-600/2-74-003 by Schwartz et al., pages 36–38, published March 1974. The EPA reference reports that HEIDA is "borderline with regard to both oral and dermal toxicity . . . "

The compound N-(dioxyethylene)-N,N-diacetic acid, also known as N-diethyleneglycol-N,N-diacetic acid, is disclosed, along with HEIDA in Japanese Laid Open Application No. 59/70652, published Apr. 21, 1984. The utility disclosed in this reference is the synthesis of chelating resins in which the iminoacids are appended to a polymeric resinous material such as polystyrene.

The object of the present invention is to provide detergent compositions which contain a safe and effective nonphosphorous detergency builder.

SUMMARY OF THE INVENTION

The present invention relates to detergent compositions which comprise a synthetic detergent and polyalkyleneglycoldiacetic acid (or a water-soluble salt thereof) as a detergency builder.

DETAILED DESCRIPTION OF THE INVENTION

In accordance with the present invention it has been found that, e.g., N-diethyleneglycol-N,N-diacetic acid (DIDA) is comparable to HEIDA in detergency builder performance, but is unexpectedly superior to HEIDA in toxicological safety and filming/streaking.

The present invention comprises built detergent compositions which comprise from about 0.01% (preferably 0.1%) to about 95% of a synthetic organic surfactant and from about 0.05% (preferably 0.5%) to about 95% of N-polyalkyleneglycol-N,N-diacetic acid or the alkali metal and ammonium salts thereof.

All percentages and ratios herein are "by weight" unless otherwise stated.

The N-Polyalkyleneglycol-N,N-Diacetic Acid Builder

The builder has the generic formula:

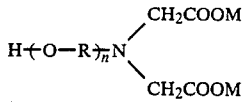

wherein each R is selected from the group consisting of ethylene and propylene, preferably ethylene, n is a number from 2 to about 8, preferably from 2 to about 5; more preferably from 2 to about 3, and each M is either H or a salt-forming cation, preferably Na, K, $NH_4(+)$, or substituted ammonium cations containing from 1 to 4 short chain alkyl or hydroxy alkyl groups each of which contains from 1 to about 3 carbon atoms.

The builders are believed to provide superior safety and/or filming/streaking.

The preferred builder is N-diethyleneglycol-N,N-diactic acid and its salts as set forth hereinafter.

N-Diethyleneglycol-N,N-Diacetic Acid (DIDA)

The compound N-diethyleneglycol-N,N-diacetic acid (DIDA) has the following structure:

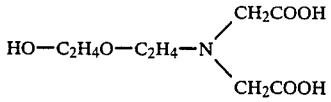

DIDA is a known compound. It can be prepared by the reaction of two moles of sodium chloroacetate and one mole of 2-(2-aminoethoxy)ethanol in aqueous medium with two mole equivalents of base to neutralize the hydrochloric acid formed in the reaction. The base can be, for example, an alkali metal base (e.g., Na or K hydroxide) or ammonium base (e.g., $Na_4OH$). This produces the dibasic salt of DIDA. The salt can be reacted with strong acid (e.g., HCl) to form the diacid or monobasic salt.

Another method of preparation is to react two moles of ethylene oxide with one mole of iminodiacetic acid in ethanol at 100°–180° C. and 10–100 atmospheres pressure in the presence of an alkali metal hydroxide catalyst (See Japanese Application No. Sho. 59-70652, published Apr. 21, 1984, incorporated by reference herein).

The term "DIDA" will be used herein to refer to both the acid and salt forms of the compound unless otherwise indicated.

The Surfactant

Compositions of this invention contain organic surface-active agents ("surfactants") to provide the usual cleaning and emulsifying benefits associated with the use of such materials.

Surfactants useful herein include well-known synthetic anionic, nonionic, amphoteric and zwitterionic surfactants. Typical of these are the alkyl benzene sulfonates, alkyl- and alkylether sulfates, paraffin sulfonates, olefin sulfonates, alkoxylated (especially ethoxylated) alcohols and alkyl phenols, amine oxides, alpha-sulfonates of fatty acids and of fatty acid esters, alkyl betaines, fluorohydrocarbon surfactants (especially anionic surfactants), and the like, which are well-known from the detergency art. In general, such detersive surfactants contain an alkyl group in the $C_9$–$C_{18}$ range. The anionic detersive surfactants can be used in the form of their sodium, potassium or triethanolammonium salts; the nonionics generally contain from about 5 to about 17 ethylene oxide groups. $C_{11}$–$C_{16}$ alkyl benzene sulfonates, $C_{12}$–$C_{18}$ paraffin-sulfonates and alkyl sulfates, and the ethoxylated alcohols and alkyl phenols are especially preferred in the compositions of the present type.

The surfactant component can comprise as little as 0.1% of the compositions herein, but typically the compositions will contain 1% to 40%, more preferably 10% to 30%, of surfactant.

A detailed listing of suitable surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporatedherein be reference.

The compositions of the present invention may be formulated into granules, liquids, solid tablet or bar form.

Granular laundry detergent compositions will generally contain from about 1% to about 40%, preferably from about 5% to about 30%, and more preferably from about 10% to about 25% surfactant, and generally from about 1% to about 40%, preferably from about 5% to about 30%, and most preferably from about 10% to about 30% of the detergency builder, especially DIDA.

Dishwashing liquids and heavy duty liquid laundry detergents generally contain 1% to about 45%, preferably about 5% to 40% and most preferably about 15% to about 35% surfactant and from about 1% to about 30%, preferably about 2% to about 25% and most preferably about 5% to about 15% of the detergency builder, especially DIDA.

Hard surface cleaner products will generally contain from about 0.01% (preferably 0.1%) to about 15%, preferably from about 0.25% to about 10%, more preferably from about 1% to about 7%, and most preferably from about 1% to about 5% surfactant, and from about 0.05% to about 10%, preferably from about 0.5% to about 10%, more preferably from about 2% to about 8%, and most preferably from about 2% to about 6% of the detergency builder, especially DIDA.

Optional Ingredients

The compositions herein can also contain the various adjuncts which are known to the art for detergent compositions. Nonlimiting examples of such adjuncts are:

Additional detergency builders such as polyphosphates (e.g., potassium pyrophosphate), nitrilotriacetates (e.g., $Na_3NTA$), sodium ethylenediaminetetraacetate, sodium ethylenetriaminepentaacetate, sodium citrate, sodium carbonate, sodium metasilicate and zeolites, e.g., zeolites having a cation exchange capacity (measured as $CaCO_3$) of 200 mg or greater per gram of zeolite;

Enzymes such as proteases and amylases;

Bleaches such as sodium perborate, diperoxydodecanedioic acid, sodium dichloroisocyanurate and m-chloroperoxybenzoic acid;

Soil suspending agents such as sodium carboxymethyl cellulose;

Bleach activators for use with sodium perborate, such as tetraacetyl ethylene diamine and sodium nonanoyloxybenzene sulfonate;

Bleach stabilizers such as sodium diethylenetriaminepentamethylenephosphonate and sodium diethylenetiaminipentaacetate;

Hydrotropes such as sodium toluene sulfonate, sodium cumene sulfonate and potassium xylene sulfonate;

Fabric softening ingredients such as smectite clay and ditallowdimethylammonium chloride;

Solvents such as pine oil, benzyl alcohol, butoxy propanol, Butyl Carbitol ® and 1(2-n-butoxy-1-methyl ethoxy)propane-2-ol (also called butoxy propoxy propanol or dipropylene glycol monobutyl ether) and diols such as 2,2,4-trimethyl1,3-pentanediol;

Abrasives such as silica, pumice, calcium carbonate, polyvinylchloride and perlite;

Aesthetic-enhancing ingredients such as colorants and perfumes.

Fillers such as sodium sulfate and water.

Sodium and potassium soaps, especially coconut soaps, can be included, especially for creams.

Preferred Hard Surface Cleaner Compositions

Particularly preferred compositions of the present invention are compositions designed especially for hard surface cleaning, wherein the builder, especially DIDA, and surfactant are used in combination with an organic solvent. These compositions have exceptionally good cleaning properties. They also have good "shine" properties, i.e., when used to clean glossy surfaces, without rinsing, they have much less tendency than phospate-built products to leave a dull finish on the surface. It is believed that this is due to the builder, especially DIDA, not crystallizing on the surface as the water/solvent evaporates. Other builders such as polyphosphates crystalllize on the surface and produce a dull appearance.

The solvents employed in the hard surface cleaning compositions herein can be any of the well-known "degreasing" solvents commonly used in, for example, the dry cleaning industry, in the hard surface cleaner industry and the metalworking industry. Many such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of solvent partly by the need to provide good grease-cutting properties, and partly by aesthetic considerations. For example, kerosene hydrocarbons function quite well in the present compositions, but can be malodorous. Kerosene can be used in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents. Pine oil can also be used.

Polar solvents such as benzyl alcohol, isopropanol, n-hexanol, glycol ethers, e.g., butoxy propanol and Butyl Carbitol® (diethyleneglycol monobutyl ether), or the phthalic acid esters can also be used in the practice of this invention. Combinations of polar and nonpolar solvents can also be used. Butoxy propanol and butoxy propoxy propanol are preferred solvents. Glycol ethers, e.g., butoxy propoxy propanol, butoxy propanol and/or hexyl carbitol in combination with the builder (DIDA) provide improved oily soil and calcium soap detergency that can be even better than can be obtained by either alone.

Generically, the glycol ethers useful herein have the formula $R^1O(R^2O)_mH$ wherein each $R^1$ is an alkyl group which contains from about 4 to about 8 carbon atoms, each $R^2$ is either ethylene or propylene, and m is a number from 1 to about 3. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water a 20° C.

Some examples of suitable diol solvents and their solubilities in water are shown in Table 1.

TABLE 1

Solubility of Selected Diols in 20° C. Water

| Diol | Solubility (g/100 g $H_2O$) |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements.
All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

The amount of solvent used in hard surface cleaner compositions herein is from about 1% to about 50%, preferably from about 1% to about 15%, more preferably from about 3% to about 11% of the composition, or from about 2% to about 10%.

The hard surface cleaner formulas can be in the form of granules or aqueous concentrates.

The invention will be illustrated by the following Examples.

EXAMPLE I

Typical Synthesis of Sodium Diethyleneglycoliminodiacetic Acid ($Na_2$ Salt)

237.7 gms (2.04 moles) of sodium chloroacetate is added to 100 ml of distilled water. To this mixture, 105.0 gms (1.0 moles) of 2-(2-aminoethoxy)ethanol dissolved in 100 ml distilled water is added slowly (5–10 minutes), with stirring. The vessel containing the mixture is then immersed in a water/ice bath and 81.6 gms (2.04 moles) of sodium hydroxide dissolved in 250 gms distilled water is slowly added with stirring, keeping the temperature at 25±1° C. The addition takes approximately 2 hours. The reaction continues to be stirred at room temperature overnight (16 hours). An aliquot is titrated with copper sulfate/murexide indicator (see titration procedure below) to check for completeness of reaction. An equal volume of methanol is added to the reaction mixture, the mixture is cooled and the precipitated sodium chloride is filtered. The mixture is concentrated by means of a rotary evaporator to a thick slurry. The methanol treatment is repeated twice more to eliminate the sodium chloride. The final product is typically a 40–45% aqueous solution of DIDA ($Na_2$ salt) and the overall yield is 80–85%. If desired, the DIDA ($Na_2$ salt) can be obtained in dry form by evaporation of the water.

The following titration method is used to determine % DIDA in solution:

Approximately 0.25 gm of sample is weighed accurately and dissolved in 75 ml of distilled water. Three drops of phenolthalein indicator is added and the sample is titrated with 0.5N HCl to an endpoint (slightly pink). 10 mls of pH buffer and 1.0 gm of murexide indicator are added and the solution is titrated with 0.025M copper sulfate solution to an endpoint. (Color at the endpoint goes from pink to purple to gray to green and gray is the endpoint). The calculation for % DIDA (Na salt) is:

$$\%\ DIDA\ (Na_2\ Salt) = \frac{\text{mls } CuSO_4 \times \text{Normality } CuSO_4 \times MW\ Na_2\ DIDA/10}{\text{wt. of sample}}$$

EXAMPLE II

A spray-dried granule of the present invention is prepared according to the following formula:

| Ingredient | Wt. % |
|---|---|
| $C_{11}$–$C_{12}$ n-Alkyl Benzene Sulfonate (Na) | 7 |
| Hydrated Zeolite A (1–10 microns) | 25 |
| DIDA ($Na_2$) | 6 |

-continued

| Ingredient | Wt. % |
|---|---|
| Silicate Solids | 2.0 |
| Sodium Sulphate | 25 |
| Sodium Perborate.4$H_2O$* | 19 |
| Tetraacetyl Ethylene Diamine* | 1.0 |
| Sodium Toluene Sulfonate | 0.6 |
| Protease Enzyme* | 0.5 |
| Na Carboxymethylcellulose | 2 |
| Brightener/Perfume*/Minors | 3 |
| Moisture | Balance |

*The composition of Example II is prepared by conventional spray-drying procedures. Ingredients indicated by an asterisk (*) are dry mixed into the spray-dried product to avoid decomposition.

Sodium perborate tetrahydrate in Example II may be replaced by an equivalent amount of sodium perborate monohydrate or sodium percarbonate, as the bleaching ingredient.

EXAMPLE III

A spray-dried laundry detergent granule of the present invention is prepared according to the following formula:

| Ingredient | Wt. % |
|---|---|
| Alpha-Sulfonated Coconut Fatty Acid (methyl ester) | 8 |
| $C_{11}$-$C_{13}$ n-Alkyl Benzene Sulfonate (Na) | 6 |
| $C_{13}$-$C_{15}$ Alcohol Ethoxylate (EO 5-8) | 12 |
| Hydrated Zeolite A (1-10 microns) | 20 |
| DIDA ($Na_2$) | 5 |
| Silicate Solids | 2.5 |
| Sodium Sulphate | 20 |
| Sodium Perborate.4$H_2O$* | 13 |
| Tetraacetyl Ethylene Diamine* | 1.0 |
| Diethylene Triamine Penta-Methylenephosphonate | 0.15 |
| Sodium Toluene Sulfonate | 0.6 |
| Protease Enzyme* | 0.5 |
| Na Carboxymethylcellulose | 2 |
| Brightener/Perfume*/Minors | 3 |
| Moisture/Miscellaneous | Balance |

*The composition of Example III is prepared by conventional spray-drying procedures. Ingredients indicated by an asterisk (*) are dry mixed into the spray-dried product to avoid decomposition.

EXAMPLE IV

A liquid heavy duty laundry detergent is prepared according to the following formula:

| Ingredient | Wt. % |
|---|---|
| Na$C_{12}$ alkyl (ethoxy)$_3$ sulfate | 11.6 |
| $C_{12-13}$ alkyl (ethoxy)$_{6.5}$ OH | 21.5 |
| DIDA ($Na_2$) | 10.0 |
| Ethanol | 10.0 |
| Brightener/perfume/enzyme/minors | 3.0 |
| Water | Balance to 100% |

This product has excellent laundry cleaning performance in cool and warm water.

EXAMPLE V

A liquid hand dishwashing composition is prepared according to the following formula:

| Ingredient | Wt. % |
|---|---|
| Na $C_{12}$ alkyl (ethoxy)$_3$ sulfate | 13 |
| Na $C_{12}$ alkyl (ethoxy)$_{12}$ sulfate | 14 |
| $C_{12}$ dimethylamine oxide | 5 |

-continued

| Ingredient | Wt. % |
|---|---|
| DIDA ($Na_2$) | 5 |
| Ethanol | 10 |
| Perfume and minors | 1 |
| Water | Balance to 100% |

EXAMPLE VI

A liquid hard surface cleaner composition of the present invention is prepared according to the following formula:

| Ingredient | Wt. % |
|---|---|
| $C_{11}$-$C_{13}$ n-Alkyl Benzene Sulfonate (Na) | 1.7 |
| Na Cumene Sulfonate | 3.0 |
| 2,2,4-Trimethyl-1,3-Pentanediol | 6.0 |
| DIDA ($Na_2$) | 3.0 |
| Distilled $H_2O$ | to 100 |

The composition is prepared by simple mixing of the ingredients in the water.

The composition when dissolved in water at a dilution of 1:64 has excellent cleaning performance, particularly in the removal of greasy kitchen soil from a no-wax floor tile. The tile surface is left with a shiny appearance, even without rinsing.

The composition can also be used undiluted, for full strength cleaning. In this context it is especially effective in removing calcium stearate soil (soap scum) from ceramic tile surfaces.

EXAMPLE VII

A liquid hard surface cleaner composition is prepared according to the following formula:

| Ingredient | Wt. % |
|---|---|
| Sodium $C_{13}$-$C_{15}$ Paraffin Sulfonate | 2.5 |
| $C_{12}$-$C_{14}$ Fatty Alcohol (Ethoxy)$_3$ | 0.6 |
| 1(2-n-butoxy-1-methyl ethoxy) propane-2-ol | 6.0 |
| DIDA ($Na_2$) | 4.0 |
| Sodium Cumene Sulfonate | 2.0 |
| Water and Minors | up to 100 |

EXAMPLE VIII

An abrasive-containing creamy scouring cleanser composition is prepared according to the following formula:

| Ingredient | Wt. % |
|---|---|
| Sodium $C_{13}$-$C_{15}$ Paraffin Sulfonate | 4.0 |
| Sodium Coconut Fatty Acid Soap | 2.0 |
| DIDA ($Na_2$) · | 3.0 |
| Sodium Carbonate | 3.0 |
| 1(2-n-butoxy-1-methyl ethoxy) propane-2-ol | 3.0 |
| Benzyl Alcohol | 1.3 |
| Calcium Carbonate | 30.0 |
| Water and Minors | up to 100 |

EXAMPLE IX

A hard surface cleaning composition especially adapted for spray-cleaning applications is prepared according to the following formula:

| Ingredient | Wt. % |
|---|---|
| Sodium $C_{12}$ Linear Alkyl Benzene Sulfonate | 1.00 |
| n-Butoxy Propanol | 7.00 |
| DIDA ($Na_2$) | 1.25 |
| Sodium Citrate | 1.25 |
| Sodium Carbonate | 0.50 |
| Sodium Cumene Sulfonate | 1.00 |
| Water and Minors | up to 100 |

EXAMPLE X

A hard surface cleaning composition especially adapted for spray-cleaning applications is prepared according to the following formula:

| Ingredient | Wt. % |
|---|---|
| Sodium $C_{12}$ Linear Alkyl Benzene Sulfonate | 1.00 |
| n-Butoxy Propanol | 7.00 |
| DIDA ($Na_2$) | 2.50 |
| Sodium Carbonate | 0.50 |
| Sodium Cumene Sulfonate | 1.00 |
| Water and Minors | up to 100 |

EXAMPLE XI

A hard surface cleaning composition is prepared according to the following formula:

| Ingredient | Wt. % |
|---|---|
| Sodium $C_{11.3}$ Linear Alkyl Benzene Sulfonate | 2.5 |
| Sodium $C_{12}$ Alcohol $(EO)_3$ Sulfate | 2.5 |
| DIDA ($Na_2$) | 3.0 |
| 1(2-n-butoxy-1-methyl ethoxy) propane-2-ol | 6.5 |
| Water and Minors - Perfume, Dye and Preservatives | up to 100 |

pH adjusted to 10.5

EXAMPLE XII

A hard surface cleaning composition is prepared according to the following formula:

| Ingredient | Wt. % |
|---|---|
| Sodium $C_{11.3}$ Linear Alkyl Benzene Sulfonate | 2.5 |
| Sodium $C_{12}$ Alcohol $(EO)_3$ Sulfate | 2.5 |
| DIDA ($Na_2$) | 6.0 |
| 1(2-n-butoxy-1-methyl ethoxy) propane-2-ol | 7.0 |
| Sodium Carbonate | 2.0 |
| Water and Minors - Perfume, Dye and Preservatives | up to 100 |

pH adjusted to 10.5

EXAMPLE XIII

The following clear liquid cleaning formulas are made and tested for filming and streaking:

| | Formula No.* | |
|---|---|---|
| Ingredient | 1 Wt. % | 2 Wt. % |
| Sodium $C_{11.3}$ Linear Alkyl Benzene Sulfonate | 2.5 | 2.5 |
| Sodium $C_{12}$ Alkyl Polyethoxylate $(EO)_3$ Sulfate | 2.5 | 2.5 |
| Coconut Fatty Acid | 0.21 | 0.21 |

-continued

| | Formula No.* | |
|---|---|---|
| Ingredient | 1 Wt. % | 2 Wt. % |
| Dipropyleneglycolmonobutyl Ether | 6.5 | 6.5 |
| N—(2-Hydroxyethyl)-iminodiacetic Acid** | 3.0 | — |
| Diethyleneglycoliminodiacetic Acid** | — | 3.0 |
| Formaldehyde | 0.01 | 0.01 |
| Color Mix | 0.4 | 0.4 |
| Perfume | 0.66 | 0.66 |
| Water | up to 100 | up to 100 |

*pH of all formulas = 10.5
**sodium salt form

Preparation of No-Wax Tiles

The vinyl no-wax floor tiles used to test filming and streaking were prepared as follows:

Soild Tiles—Four dark colored, high gloss, floor tiles are washed first with a mild cleanser, followed by isopropyl alcohol, and finally with deionized water. A greasy/particulate kitchen soil (a mixture of 77.8% commercial vegetable oils and 22.8% particulate soil, composed of humus, sand, fine cement, clay, ferrous oxide, and carbon black) is used to soil the tiles. A small amount of soil is spread evenly on a small paint roller (3" wide, ¼" nap). The soil is lightly rolled onto 4 tiles until a very light coating can be seen. The panels are lightly buffed with a small cloth rag until a very light haze is visible.

The following method is used to determine the amounts of filming and streaking on floor tiles in a soiled and nonsoiled context:

Clean cut sponges (measuring approximately 3½-×1½"×¾") are dipped in hot water for several minutes. The sponges are maintained in 110° F., 7 grain water. Dilute solutions of the test products are made by adding 1 part of the formula to 64 parts of 7 grain, 110° F. water. Excess water in the sponge is wrung out and 10.0 grams of the dilute solution is dropped evenly onto one face of the sponge. Each floor tile is divided into two 12" vertical by 6" horizontal sections. The sponge is wiped lightly and slowly over the floor surface by starting in the bottom left-hand corner of the section, wiping up, across, and down to the bottom right corner of the section. The pattern is then retraced back to the original position. This consitutes one complete cycle. For nonsoiled tiles, one cycle is performed. For soiled tiles, two cycles are performed. The tiles are air dried for 20 minutes and graded under 150 watt flood lamps by expert graders using the following scale:

1=very heavy filming/streaking
2=heavy
3=moderate
4=light
5=no visible filming/streaking The results are as follows:

Filming and Streaking

| | Formula | |
|---|---|---|
| | 1 | 2 |
| No Soil Grade | 3.4 | 4.5 |
| Soil Grade | 2.4 | 3.6 |

What is claimed is:

1. A detergent composition for cleaning hard surfaces, having reduced filming and streaking characteristics, and consisting essentially of from about 0.01% to about 95% of an organic synthetic surfactant, and from about 0.05% to about 95% of a detergent builder compound of the formula:

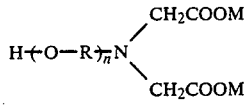

wherein each R is selected from the group consisting of ethylene and propylene; n is a number from 2 to about 8; and each M is either hydrogen or a salt-forming cation.

2. The composition of claim 1 wherein said detergency builder compound has the formula:

$HO—C_2H_4O—C_2H_4—N(CH_2COOM)_2$.

3. The composition of claim 1 containing, as an additional ingredient, from about 1% to about 15% of an organic solvent having the formula $R^1O(R^2O)_mH$ wherein each $R^1$ is an alkyl group which contains from about 4 to about 8 carbon atoms, each $R^2$ is selected from the group consisting of ethylene or propylene, and m is a number from 1 to about 3.

4. A hard surface cleaner composition according to claim 1 having from about 0.01% to about 15% of an organic synthetic surfactant and from about 0.05% to about 10% of a detergency builder of the formula:

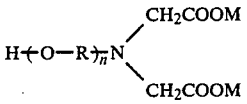

wherein each R is selected from the group consisting of ethylene and propylene; n is a number from 2 to about 8; and each M is either hydrogen or a salt-forming cation.

5. The composition of claim 4 wherein said detergency builder compound has the formula:

$HO—C_2H_4O—C_2H_4—N(CH_2COOM)_2$.

6. The composition of claim 4 wherein the amount of said organic synthetic surfactant is from about 0.1% to about 5% and the amount of said detergency builder is from about 2% to about 8%.

7. The composition of claim 4 in the form of an aqueous liquid.

8. The composition of claim 4 containing, as an additional ingredient, from about 1% to about 15% of an organic solvent have a boiling point above 20° C.

9. The composition of claim 8 wherein the solvent is selected from the group consisting of alkyl and cycloalkyl hydrocarbons and halohydrocarbons, alpha olefins, benzyl alcohol, pine oil, glycol ethers, isopropanol, and diols containing 6 to 16 carbon atoms.

10. The composition of claim 8 wherein the solvent is a diol containing from about 8 to about 12 carbon atoms.

11. The composition of claim 8 wherein the solvent is 2,2,4-trimethyl-1,3-pentanediol.

12. The composition of claim 4 containing, as an additional ingredient, from about 1% to about 15% of an organic solvent having the formula $R^1O(R^2O)_mH$ wherein each $R^1$ is an alkyl group which contains from about 4 to about 8 carbon atoms, each $R^2$ is selected from the group consisting of ethylene or propylene, and m is a number from 1 to about 3.

13. The composition of claim 12 wherein the solvent is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

* * * * *